US006758551B2

(12) United States Patent
Tien et al.

(10) Patent No.: US 6,758,551 B2
(45) Date of Patent: Jul. 6, 2004

(54) DISTRIBUTED HIGH EFFICIENCY RF SUPPLY

(75) Inventors: Paul C. Tien, Torrance, CA (US); Mehrdad Zomorrodi, West Hills, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/305,593

(22) Filed: Nov. 26, 2002

(65) Prior Publication Data

US 2004/0100534 A1 May 27, 2004

(51) Int. Cl.[7] ..... B41J 2/05
(52) U.S. Cl. ..... 347/57; 347/59
(58) Field of Search ..... 347/20, 56, 57–59, 347/10, 11, 46, 47

(56) References Cited

U.S. PATENT DOCUMENTS

| | | | | |
|---|---|---|---|---|
| 5,629,578 | A | 5/1997 | Winzer et al. | 310/334 |
| 5,912,679 | A | 6/1999 | Takayama et al. | 347/10 |
| 6,273,551 | B1 * | 8/2001 | Guerin et al. | 347/46 |

* cited by examiner

*Primary Examiner*—Juanita D. Stephens
(74) *Attorney, Agent, or Firm*—Oliff Berridge, PLC

(57) ABSTRACT

An acoustic inkjet print head having the RF generator and amplifier located at the load location for directly driving the load is disclosed. In so doing the power distribution medium, e.g. transmission line and any power divider device are eliminated. The overall power efficiency can be near to the high efficiency amplifier. In the case of Class-E, greater than 90 percent efficiency can be achieved. Due to the miniaturization of components the high efficiency power supply can be shielded effectively to minimize EME and can be further be integrated to a MCM or IC.

19 Claims, 2 Drawing Sheets

DISTRIBUTED HIGH EFFICIENCY RF SUPPLY

BACKGROUND

This application is related to acoustic inkjet printing system and more particularly to an acoustic inkjet print head with an integrated RF generator and integrated power RF amplifier.

Distribution of RF power to multiple loads required power splitters to reduce power loss. As the number of output and loads are greater than a few, the cost and space of power splitters become non-economical and bulky. Therefore it is difficult to integrate to a MCM (Multi Chip Module) or IC. In some applications when the output number is in the dozens, splitter and transmit solutions are no longer viable due to low power efficiency as well as the cost and space problems.

It is an object of this invention to eliminate the high power dissipation to substantially improve the efficiency and reduce the cost. It is another object of this invention to integrate the RF signal generation onto the print head. It is yet another object of this invention to eliminate the non-uniformity of the print quality.

SUMMARY OF THE INVENTION

According to the present invention, there is disclosed an acoustic inkjet print head which locates the RF generator and amplifier at the load location for directly driving the load. In so doing the power distribution medium, e.g. transmission line, and any power divider device are eliminated. The overall power efficiency can be near to the high efficiency amplifier. In the case of Class-E, greater than 90 percent efficiency can be easily achieved. Due to the miniaturization of components the high efficiency power supply can be shielded effectively to minimize EME and can be further integrated to a MCM or IC.

DESCRIPTION OF THE DRAWING

Figure 1:
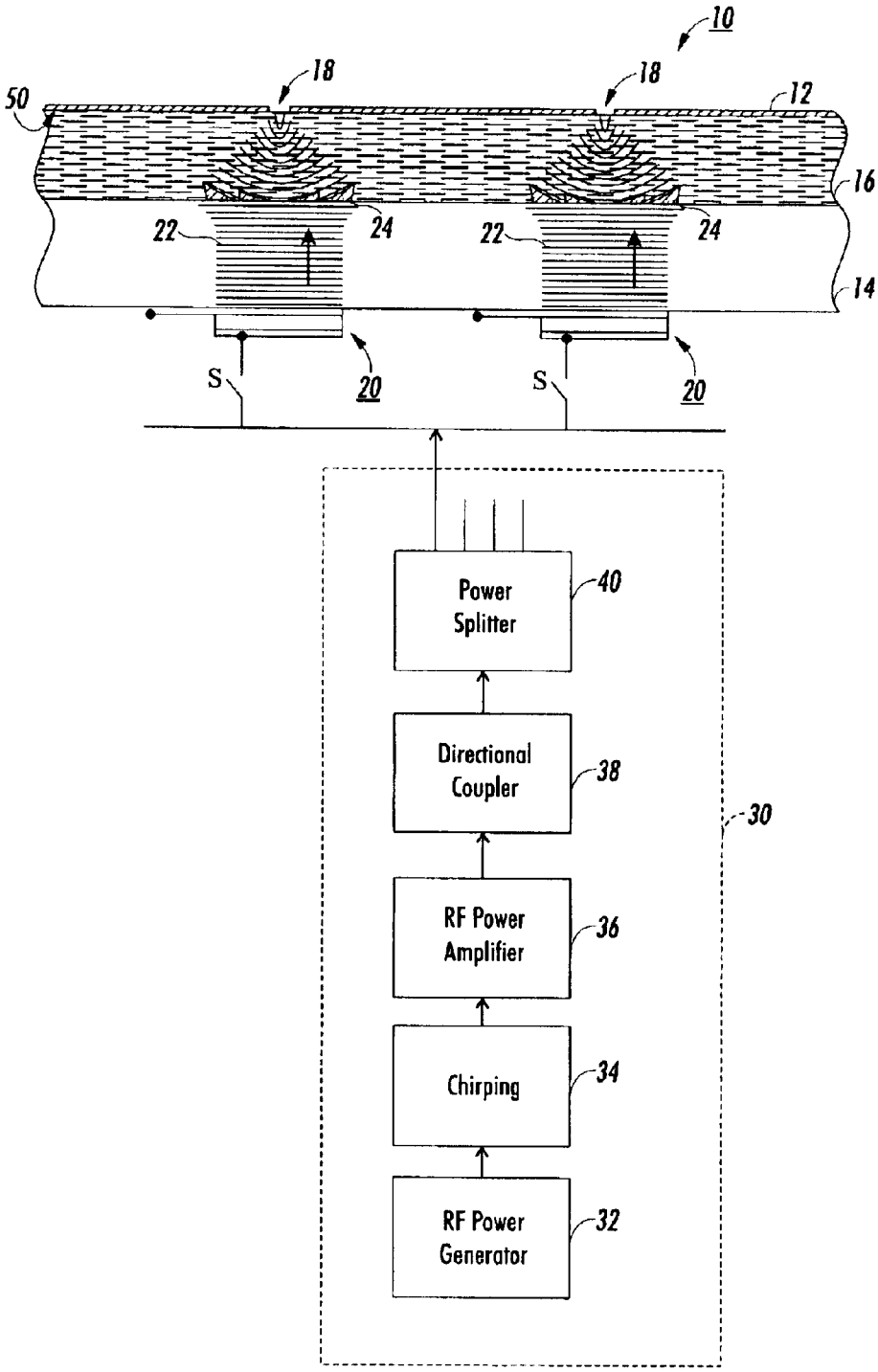
FIG. 1 Prior Art
FIG. 1 shows a portion of a cross sectional view of a prior art acoustic inkjet print head and the external high power RF generating block.

Referring to FIG. 1, there is shown a portion of a cross sectional view of a prior art acoustic inkjet print head 10. Print head 10 has a housing 12, which contains a sheet of glass substrate 14 and ink 16 over the glass substrate 14. Housing 12, has a plurality of apertures 18, each of which is dedicated to a pixel. Under the glass substrate, there is a plurality of piezoelectric transducers 20. For the purpose of simplicity, hereinafter, the "piezo-electric transducer" is referred to as "transducer". Each transducer 20 is dedicated to one aperture 18 and is located directly across its respective aperture 18. Once each transducer 20 is activated, it will oscillate and generate acoustic waves 22. The acoustic waves 22 travel within the glass substrate 14 toward the ink 16.

Over the glass substrate 14, there is a plurality of Fresnel lenses 24, each of which corresponds to one of the transducers 20 and is located across from its respective transducer 20. The Fresnel lenses 24 receive the acoustic waves 22 from the transducers 20 and focus the acoustic waves onto their respective aperture 18. The focused waves 22 cause the ink to be ejected from the apertures.

Transducers 20, which are arranged in a two-dimensional array, need a high power RF signal to operate. In the conventional inkjet printing systems, the high power RF signal is generated externally and delivered to the print head. In FIG. 1, block 30, which is an external block to the print head 10, provides the high power RF signal to the transducers 20.

Within block 30, RF generator block 32 generates an RF signal and sends it to a chirping block 34. The chirping block 34 chirps the RF signal. In this specification, "chirping" is defined as variation of the frequency of the RF signal between 100 to 135 MHz and modulation of the amplitude of the RF signal. The output of the chirping block 34 is sent to a high power RF amplifier 36 which amplifies the RF signal to generate a high power RF signal and sends it to the directional coupler 38. In this specification high power RF signal is defined as a signal in the range of 40–100 watts.

The directional coupler 38 acts as wave guide and transfers the high power RF signal to the power splitter 40 where the high power RF is split. Each output of power splitter 40 is connected to a respective row of the transducers 20 to provide high power RF signal to all the transducers 20 of that row through individual switches S. Switches S are controlled by pixel information. Based on the pixel information, when a given pixel needs ink, switch S of a respective transducer closes to send the high power RF signal to that transducer for activating the transducer and causing ink to be ejected from the respective aperture 18.

The conventional architecture has several drawbacks. Since the high power RF generating block 30 has to generate a high power RF signal, it requires large power handling components which in turn cause the high power RF generating block 30 to have a large size and a high cost in the order of a few thousand dollars. Transmission of high power RF signal from block 30 to the transducers 20 of the print head 10 requires coaxial cables or waveguides that again are costly. Due to the usage of the coaxial cables, impedance matching at both ends of each coaxial cable is necessary and critical. However, the number of the fully on transducers is different at any given time based on the pixel data. This in turn causes the total impedance of the transducers to be different at any given time. The varying total impedance causes a miss-match between the impedance of the two ends of the coaxial cables, which leads into power waste. In the acoustic inkjet print heads, the inefficiency of the high power RF generation and transmission is typically over 50%.

In addition, the high power RF generating block 30 generates a great deal of heat and electromagnetic emission which can affect the function of the nearby circuits or acousto-optical elements of the print head. Also, since the chirping circuit, splitters, and the additional necessary circuits of harmonic reduction filters, mixer and equalizer have to handle a power signal, they cost several times higher than low power circuits. Finally, since one central high power RF signal is used to activate the transducers, regardless of the number of active transducers, the high power RF generating block 30 has to be fully on. This suggests a waste of high power which is costly to produce and maintain. In summary, the conventional high power RF generation and transmission in an acoustic inkjet print head is costly, large, hot and inefficient.

Furthermore, the varying total impedance of the transducers and the different distances of the different transducers from the power splitter 40 cause different amount of power to reach each transducer 20. Therefore, different pixels receive different amount of ink, which is caused by the different energy of the acoustic waves generated by the transducers as a result of different amount of high power RF signal. The varying amount of ink causes a non-uniformity in the quality of the printed document which is shown as the variation of ink darkness.

Figure 2:
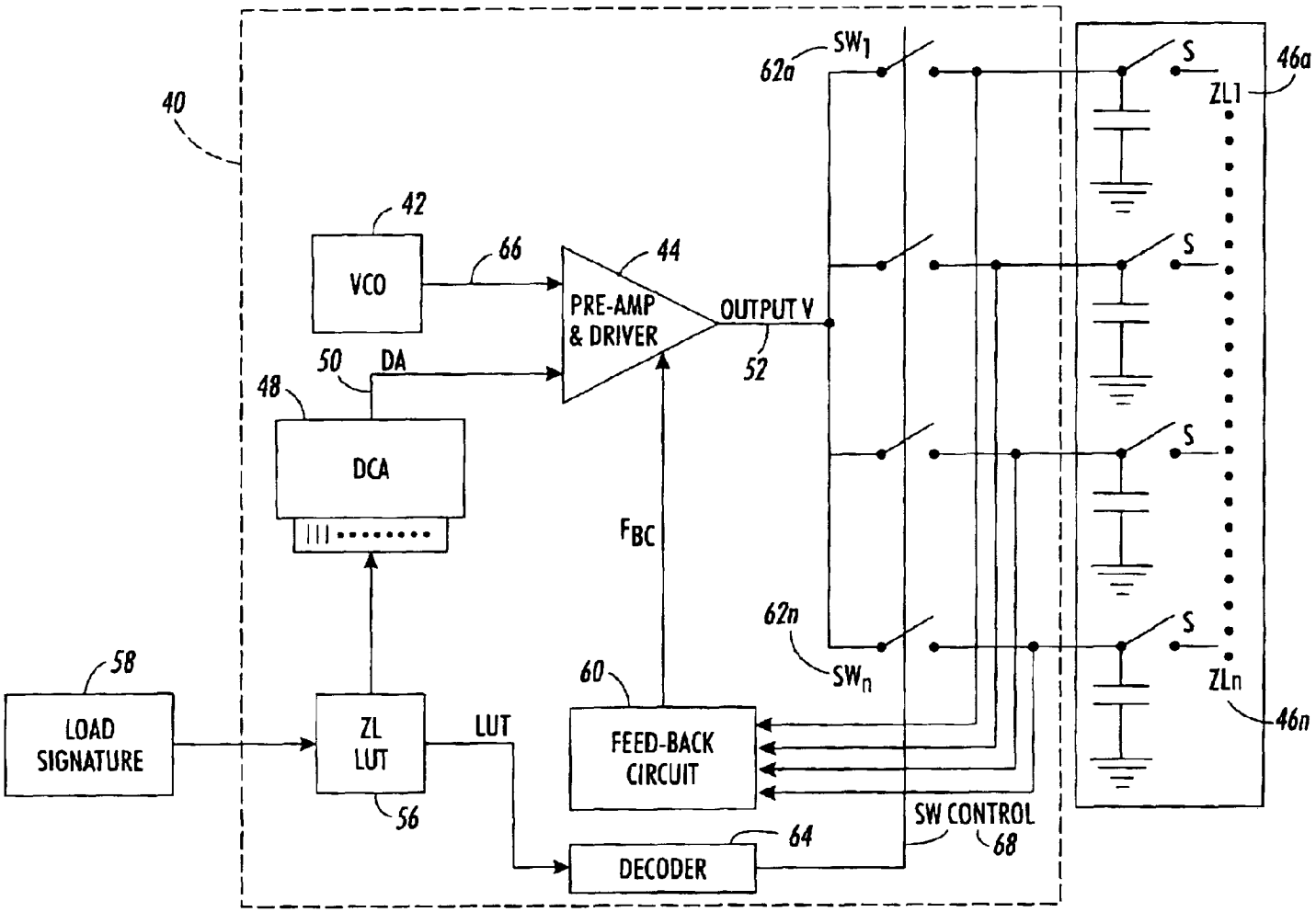
FIG. 2 shows a block diagram of the electronic circuit of an acoustic inkjet print head of this invention.

Referring now to FIG. 2, there is shown a block diagram 40 of the electronic circuit of an acoustic inkjet print head of this invention. A voltage controlled oscillator 42 (VCO) is utilized as a precision RF signal source which generates a low power RF signal. In this specification, low power is defined as a power within the range of a few milliwatts. By way of example but not of limitation, the signal power of the VCO 42 is amplified by a Class-E pre-amplifier and driver (power amplifier) circuit 44. As shown in FIG. 2, the pre-amplifier 44 takes feedback signals from multiple loads $ZL_1$ 46*a* to $ZL_n$ 46*n* by way of input from a feedback circuit $F_{BC}$ 60 and DA 50 in such a way that the amplitude of the output voltage is kept at a constant level. The multiple loads $ZL_1$ 46*a* to $ZL_n$ 46*n* define the impedance characteristics (due to their location in the print head) of the transducers or "piezo-electric" elements described and shown in FIG. 1.

More specifically, by use of feedback $F_{BC}$ 60 and DA 50 the output voltage level of the power amplifier 44, OutputV 52, is at a constant level regardless of changes in the load values $ZL_1$ 46*a* to $ZL_n$ 46*n*. Therefore a precision power level is generated in accordance with the following equation:

$$P=Va^{**}2/ZL_n \qquad \text{equation 1;}$$

and is delivered to each of the multiple load values $ZL_1$ 46*a* to $ZL_n$ 46*n*, where Va is the rms value of OutputV 52. Referring once again to FIG. 2, a Digital to Analog Converter 54 (DAC) converts the digital signature of a load $ZL_1$ 46*a* to $ZL_n$ 46*n*, via Look Up Table 56 (LUT), to analog signal input to the pre-amplifier 44. By way of example but not of limitation, the digital signal of each load $ZL_1$ 46*a* to $ZL_N$ 46*n* could be anywhere from a one bit to n bit word. The Look Up Table 56 is created by measuring the impedance of the transducers based on their location in the print head creating a load signature 58 which is then transferred in tabular form and stored in the Look Up Table 56.

Each load $ZL_1$ 46*a* to $ZL_n$ 46*n* will have a specific DA 50 value wherein the corresponding OutputV 52 value will be guaranteed. A digital word LUT corresponds to a selected $ZL_n$ 46*n* and is sent to decoder 64. Decoder 64 controls a plurality of RF switches $SW_1$ 62*a* to $SW_n$ 62*n* and turns on the corresponding switch according to the load signature stored in the Look Up Table 56. In one example this may be accomplished by sequentially tuning on each switch by switch control 68 comprising a clock and timing routine (not shown). The RF switches $SW_1$ 62*a* to $SW_n$ 62*n* are low impedance analog switches for sending the power to a selected load $ZL_1$ 46*a* to $ZL_n$ 46*n*. The signal generator 42, DAC 48, LUT 56, feedback circuit 60, decoder 64 and RF switches $SW_1$ 62*a* to $SW_n$ 62*n* of this invention can be all integrated on one silicon chip. Also, the RF generator 48 can be integrated on the same silicon chip as the power amplifiers 44. Since the generation of RF signal is accomplished on a silicon chip containing the RF generator 42 and the single power amplifier 44, this silicon chip can be integrated onto the acoustic inkjet print head.

The disclosed embodiment of this invention eliminates the high power RF generators, coaxial cables or wave guides, power splitter, power mixer, power equalizer and directional coupler used in conventional acoustic inkjet system. The power splitter, mixers, and equalizers are all used to support the high power signal transmission and not needed when the RF signal is a low power signal.

The disclosed embodiment of this invention substantially improves the efficiency of high power RF generation and delivery to the transducers and substantially reduces the cost of acoustic inkjet print head and the non-uniformity on the printed document.

It should be noted that numerous changes in details of construction and the combination and arrangement of elements may be resorted to without departing from the true spirit and scope of the invention as hereinafter claimed

What is claimed is:

1. An acoustic inkjet print head comprising:

a plurality of transducers for generating acoustic waves;

a plurality of RF power switches, each of which corresponds to one of said plurality of transducers;

an RF frequency generator and RF power amplifier controlled by a load value for coarse adjustment;

said RF frequency generator and amplifier being electrically connected to each one of said plurality of transducers through a corresponding one of said plurality of RF power switches; and said plurality of transducers, said RF power amplifier and said RF frequency generator being so constructed and arranged to be all integrated on the acoustic inkjet print head.

2. The acoustic inkjet print head recited in claim 1, wherein said RF power amplifier and said RF frequency generator are all integrated on a silicon chip.

3. The acoustic inkjet print head recited in claim 1, wherein said load value is obtained from a load impedance lookup table.

4. The acoustic inkjet print head recited in claim 3, wherein said RF power amplifier is controlled by a load impedance feedback circuit for fine adjustment.

5. The acoustic inkjet print head recited in claim 1, wherein said RF power amplifier is a Class E amplifier.

6. The acoustic inkjet print head recited in claim 1, wherein said RF power switches are turned on and off by a decoder.

7. The acoustic inkjet print head recited in claim 6, wherein said decoder turns on a corresponding RF switch according to a load signature in a look-up table.

8. The acoustic inkjet print head recited in claim 1, wherein said RF power generator and amplifier receives a feedback and signal from a Digital to Analog Converter for delivering a constant output voltage with varying changes in load values.

9. An acoustic inkjet print head comprising:

a plurality of transducers each having load impedance values for generating acoustic waves;

a plurality of RF power switches, each of which corresponds to one of said plurality of transducers;

an RF frequency generator and amplifier;

said RF frequency generator and amplifier being electrically connected to each one of said plurality of transducers through a corresponding one of said plurality of RF power switches wherein said RF power generator and amplifier receives a feedback signal from a feedback circuit and digital signature from a Digital to Analog Converter for delivering a constant output voltage with varying changes in load values; and said plurality of transducers, said RF power amplifier and said RF frequency generator being so constructed and arranged to be all integrated on the acoustic inkjet print head.

10. The acoustic inkjet print head recited in claim 9, wherein said RF power amplifier and said RF frequency generator are all integrated on a silicon chip.

11. The acoustic inkjet print head recited in claim 9, wherein said RF power amplifier is controlled by a load value corresponding to a transducer for coarse adjustment.

12. The acoustic inkjet print head recited in claim 11, wherein said load value is obtained from a load impedance lookup table.

13. The acoustic inkjet print head recited in claim 12, wherein said RF power amplifier is controlled by a load impedance feedback circuit for fine adjustment.

14. The acoustic inkjet print head recited in claim 9, wherein said RF power amplifier is a Class E amplifier.

15. The acoustic inkjet print head recited in claim 9, wherein said RF power switches are turned on and off by a decoder.

16. The acoustic inkjet print head recited in claim 15, wherein said decoder turns on a corresponding RF switch according to a load signature in a look-up table.

17. An acoustic inkjet print head comprising:

a plurality of transducers each having predetermined load impedance values for generating acoustic waves;

a plurality of RF power switches each of which corresponds to one of said plurality of transducers said RF power switches which are turned on and off by a decoder wherein said decoder turns on a corresponding RF switch according to a load signature in a look-up table;

an RF frequency generator and amplifier;

said RF frequency generator and amplifier being electrically connected to each one of said plurality of transducers through a corresponding one of said plurality of RF power switches wherein said RF power generator and amplifier receives a feedback signal from a feedback circuit and digital signature from a Digital to Analog Converter for delivering a constant output voltage with varying changes in load values; and said plurality of transducers, said RF power amplifier and said RF frequency generator being so constructed and arranged to be all integrated on the acoustic inkjet print head.

18. The acoustic inkjet print head recited in claim 17, wherein said RF power amplifier is controlled by a load value for coarse adjustment.

19. The acoustic inkjet print head recited in claim 17, wherein said RF power amplifier is controlled by a load impedance feedback circuit for fine adjustment.

* * * * *